US012144405B2

(12) United States Patent
Colpo et al.

(10) Patent No.: US 12,144,405 B2
(45) Date of Patent: Nov. 19, 2024

(54) COMPONENT FOR JEWELLERY AND/OR COSTUME JEWELLERY ITEMS

(71) Applicant: Colpo & Zilio S.P.A., Torri di Quartesolo (IT)

(72) Inventors: Renzo Colpo, Vicenza (IT); Roberto Peretto, Dueville (IT)

(73) Assignee: Colpo & Zilio S.P.A., Vicenza (IT)

( * ) Notice: Subject to any disclaimer, the term of this patent is extended or adjusted under 35 U.S.C. 154(b) by 0 days.

(21) Appl. No.: 18/014,153

(22) PCT Filed: Jul. 1, 2021

(86) PCT No.: PCT/IB2021/055915
§ 371 (c)(1),
(2) Date: Dec. 31, 2022

(87) PCT Pub. No.: WO2022/013669
PCT Pub. Date: Jan. 20, 2022

(65) Prior Publication Data

US 2023/0225465 A1 Jul. 20, 2023

(30) Foreign Application Priority Data

Jul. 15, 2020 (IT) ..... 102020000017176

(51) Int. Cl.
*A44C 5/10* (2006.01)
*A44C 11/00* (2006.01)
(Continued)

(52) U.S. Cl.
CPC ..... *A44C 5/107* (2013.01); *A44C 11/00* (2013.01)

(58) Field of Classification Search
CPC ..... A44C 5/107; A44C 11/00; B21L 11/005; B21L 11/08; B21L 11/04; F16G 15/12
(Continued)

(56) References Cited

U.S. PATENT DOCUMENTS 4,625,508 A * 12/1986 Fontana ..... A44C 5/105 63/4

FOREIGN PATENT DOCUMENTS

CH 713314 B1 1/2021
DE 3409357 A1 3/1985
(Continued)

OTHER PUBLICATIONS

European Patent Office, Communication under Rule 71(3) EPC (Intention to grant), pp. 46, dated Jun. 25, 2024, Application No. 21 743 581.7-1017.

*Primary Examiner* — Jack W Lavinder
(74) *Attorney, Agent, or Firm* — Casey Kniser

(57) ABSTRACT

The present invention concerns a component (10; 110; 210) for a jewellery and/or costume jewellery item (1; 101; 201; 301), suited to be used for making chains, small chains, necklaces, bracelets, earrings and similar items. The component (10; 110; 210) comprises a first element (20; 120; 220) and a second element (40; 140; 240) connected together in such a way as to form a chain section. The first element (20; 120; 220) and the second element (40; 140; 240) can be coupled at the level of two contact areas (62, 64; 162, 164; 262, 264), wherein in at least one of the two contact areas (62, 64; 162, 164; 262, 264) the first element (20; 120; 220) comprises a first contact surface (22, 24; 122, 124; 222, 224) which is lowered with respect to the adjacent surfaces (22*a*, 22*b*; 24*a*, 24*b*) and wherein the first lowered contact surface (22, 24; 122, 124; 222, 224) is suited to receive a second contact surface (42, 44; 142, 144; 242, 244) of the second element (40; 140; 240). The component (10; 110; 210) comprises articulation means (12; 112; 212) for coupling the component (10; 110; 210) with another component (10; 110; 210) of the jewellery and/or costume jewellery item (1; 101; 201; 301).

20 Claims, 16 Drawing Sheets

(51) Int. Cl.
*B21L 11/00* (2006.01)
*F16G 15/12* (2006.01)

(58) Field of Classification Search
USPC ..... 59/80, 82
See application file for complete search history.

(56) References Cited

FOREIGN PATENT DOCUMENTS

| | | | |
|---|---|---|---|
| EP | 313711 | A1 | 5/1989 |
| FR | 2875385 | A1 | 12/2006 |

* cited by examiner

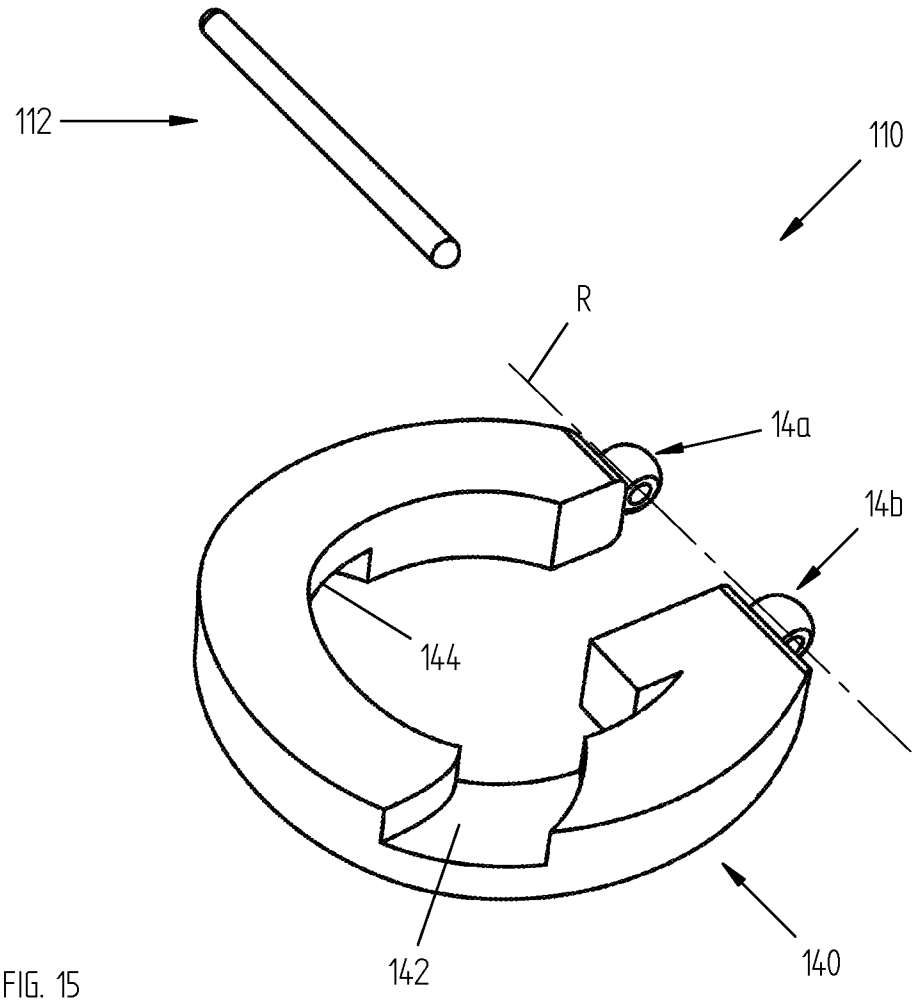
FIG. 15
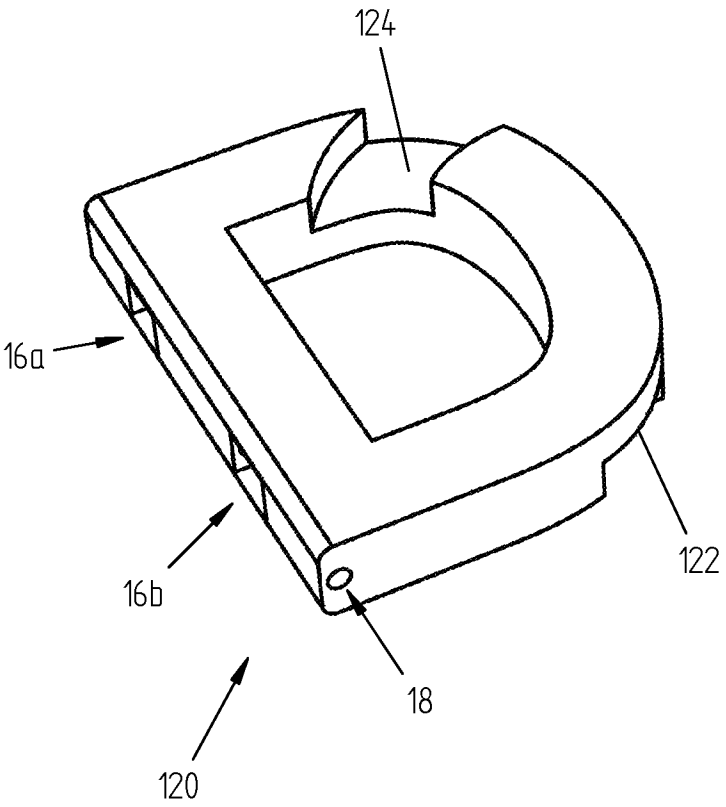

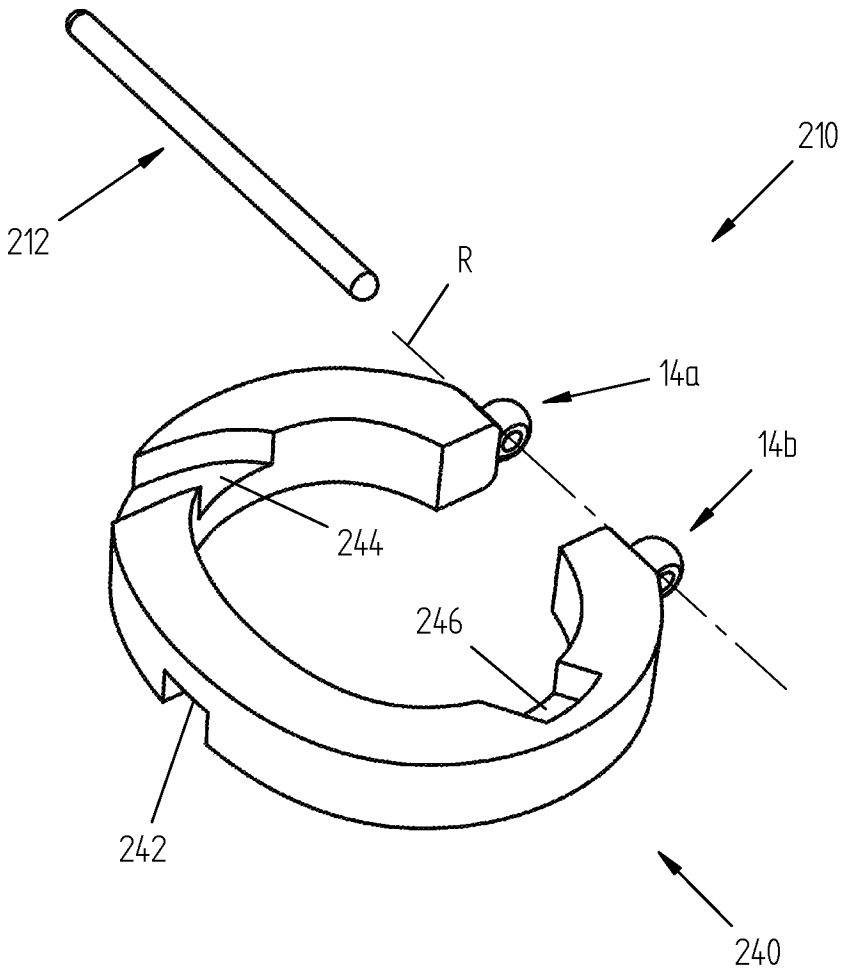
FIG. 18
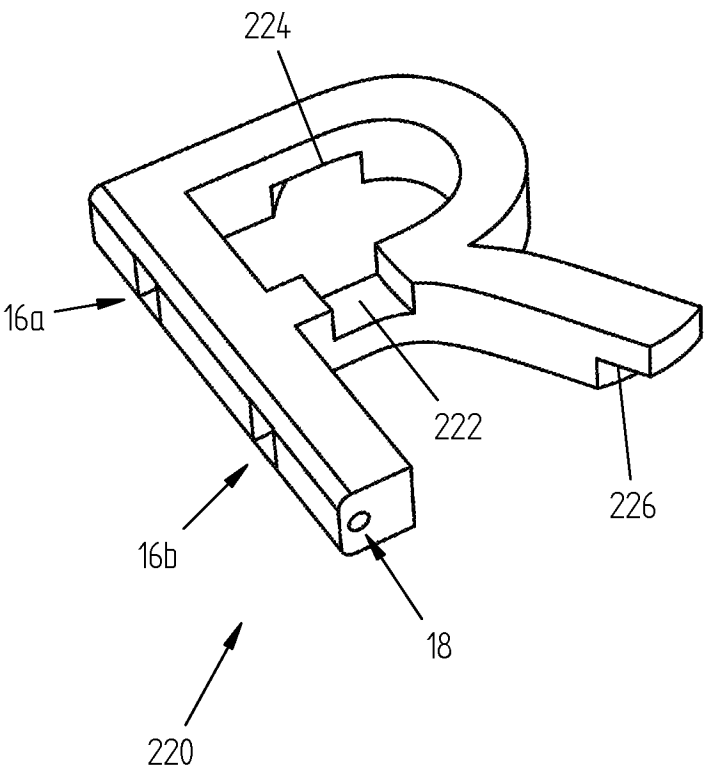

COMPONENT FOR JEWELLERY AND/OR COSTUME JEWELLERY ITEMS

TECHNICAL FIELD OF THE INVENTION

The present invention concerns jewellery and/or costume jewellery items. More specifically, the present invention concerns jewellery and/or costume jewellery items such as, for example, small chains, chains, necklaces, bracelets, pendants, charms, earrings and similar items. In greater detail, the present invention concerns a solution regarding the production of a section comprising two elements for jewellery and/or costume jewellery items such as, for example, a chain, a necklace, a bracelet, earrings and similar items. In even greater detail, the present invention concerns the way in which said two elements are connected and/or constrained to each other.

The present invention thus concerns an interchangeable section of a jewellery item such as, for example, a chain, a small chain, a necklace or a bracelet or an earring or similar items, said section comprising at least two elements conveniently connected to each other.

DESCRIPTION OF THE STATE OF THE ART

It is known that the production of jewellery and/or costume jewellery items such as, for example, small chains, chains, bracelets, necklaces, earrings and similar items has always been a challenging task for jewellers. This is due especially to the fact that during the production of a jewellery item of the type mentioned above different needs must be taken in consideration, such as for example the aesthetic appearance or external aspect of the item, its functionality as well as its production and/or manufacturing costs. The aesthetic appearance of jewellery items such as, for example, a chain, a necklace or a bracelet strictly depends on how its component parts (hereinafter referred to as links) are connected to each other. The links of a chain or a bracelet, in fact, tend to assume different orientations and positions when said chain or said bracelet is worn; in particular, two consecutive links of a chain, of a necklace or of a bracelet will tend to be oriented with their respective longitudinal planes of symmetry on different planes and in such a way as to form an angle, usually an angle of approximately 90 degrees. It is thus clear that the final aesthetic effect to be obtained cannot be independent from the mutual orientation of the successive links of a chain and thus from the way in which said links are connected to each other. Even the degrees of freedom of the successive annular elements of a chain have a determinant role in the final aesthetic appearance to be obtained; said degrees of freedom must therefore be taken in consideration when designing the necklace or bracelet, otherwise there is the risk of achieving a final effect that is different from the effect desired. More specifically, to obtain a given aesthetic effect it is often necessary to limit the degrees of freedom of the elements of a chain or bracelet and therefore the possible mutual positions that the same successive elements or links can assume when the chain or bracelet or in any case the jewellery item is worn by the user. A further factor that must be considered very carefully regards the process adopted for making and/or producing jewellery items; usually, especially in the case of the costume jewellery items characterized by a final price that in any case is limited, there is a tendency to simplify the assembly operations, precisely in order to limit the production and/or manufacturing costs. However, the possible solutions (the viable production steps) are limited in any case, and they strongly depend on the type of links to be obtained and on how these are connected to each other. In other words, the final aesthetic appearance to be obtained limits and determines the viable production and/or manufacturing steps.

Several efforts and attempts have thus been made by jewellers in order to find solutions capable of meeting the needs described above and therefore to obtain components for jewellery and/or costume jewellery items which have a pleasant aesthetic appearance and external aspect and are easy to produce. Different and numerous solutions are known in the state of the art. It should however be underlined that, notwithstanding the efforts and the attempts made, the solutions proposed in the state of the art are seldom able to meet all the previously described needs in a suitable manner. For example, some solutions are known which are suited to limit the degrees of freedom and therefore the mutual movement of two successive links of a chain or a bracelet so that, once worn, said chain and/or said bracelet has/have a predefined external aspect and aesthetic appearance. It has however been found out that the adopted solutions are either difficult to implement (with complex procedures and high costs) or even such as to cause contrary and undesired effects such as, for example, the loss of flexibility or in any case a rigidity that the users do not like. Even from the aesthetic point of view, the solutions proposed in the past were not viable, as it was difficult to "conceal" the connection between two successive annular elements, so that the overall and final aesthetic appearance of the jewellery and/or costume jewellery item was too heavily affected by said connections. Finally, none of the known solutions has made it possible to overcome the problem that is probably considered most important, that is, how to connect two successive elements or links of a chain in such a way as to limit their degrees of freedom and thus to define in advance the possible mutual positions which said two successive elements will assume when the jewellery and/or costume jewellery item is worn, while at the same time ensuring that said connection can be carried out according to a simple procedure, at limited costs and in any case guaranteeing a pleasant aspect and overall aesthetic appearance.

The main object of the present invention is thus to solve or at least partially overcome the problems that characterize the solutions known in the art. In particular, it is a further object of the present invention to propose an innovative solution with regard to the way in which two successive elements of a jewellery and/or costume jewellery item such as, for example, a necklace, a chain, an earring or a bracelet can be connected to each other.

More specifically, it is a further object of the present invention to propose an innovative solution that makes it possible to connect two successive elements of a chain, a bracelet, an earring and/or similar jewellery and/or costume jewellery items while limiting the degrees of freedom of said two successive elements, thus reducing the range of the possible mutual positions which said two successive elements can assume.

It is a further object of the present invention to propose an innovative method according to which the two successive elements of a necklace, a chain or a bracelet can be mutually connected and constrained.

In particular, it is one of the objects of the present invention to propose a method that makes it possible to mutually constrain or connect two successive elements of a chain, a necklace, a bracelet or an earring through relatively simple operations and at relatively low costs.

It is one of the other objects of the present invention to obtain a jewellery and/or costume jewellery item comprising at least two successive elements connected to each other and having a pleasant aesthetic appearance and external aspect.

It is a further object of the present invention to propose a solution that makes it possible to simplify and speed up the assembly operations of a jewellery and/or costume jewellery item such as, for example, a necklace, a chain, a bracelet, an earring or similar items.

DESCRIPTION OF THE PRESENT INVENTION

According to a first aspect of the present invention, therefore, the subject of the same is a component for a jewellery and/or costume jewellery item, suited to be used for making chains, small chains, necklaces, bracelets, earrings and similar items, said component comprising a first element and a second element connected to each other in such a way as to form a chain section, wherein said first element and said second element are suited to be coupled together at the level of two contact areas, wherein in at least one of said two contact areas said first element comprises a first contact surface which is lowered with respect to the adjacent surfaces, said first lowered contact surface being suited to receive a second contact surface of said second element and wherein said component comprises articulation means for coupling said component with another component of said jewellery and/or costume jewellery item.

According to a preferred embodiment of the invention, the second contact surface of the second element comprises a contact surface which is lowered with respect to the adjacent surfaces.

Preferably, in both contact areas the first element comprises first contact surfaces which are lowered with respect to the adjacent surfaces and suited to receive second contact surfaces of the second element.

In a preferred embodiment, the second contact surfaces of the second element comprise contact surfaces which are lowered with respect to the adjacent surfaces.

According to a preferred embodiment of the invention, at least one between the first element and the second element comprises at least one closed annular section where the two contact areas are defined and the other one between the first element and the second element is an open element having free ends and suited to be inserted in said closed annular section.

Preferably, the first element and the second element are connected to each other in such a way that they are both oriented according to substantially the same direction with respect to a plane reference surface.

The expression "same orientation" of the two elements makes reference to the orientation of two respective planes defined for the first element and the second element, wherein the plane of the first element substantially corresponds to the plane passing through the points where the first element rests on a plane reference surface when the first element has not been assembled with the second element yet and wherein the plane of the second element substantially corresponds to the plane passing through the points where the second element rests on a plane reference surface when the second element has not been assembled with the first element yet.

In a preferred embodiment, the first lowered contact surface is inclined, along a first direction, by a first angle included between 1.20° and 19°, preferably equal to 9.50°, with respect to said plane reference surface.

According to a preferred embodiment of the invention, the first lowered contact surface is inclined, along a second direction, by a second angle included between 1.2° and 8°, preferably equal to 3.80°, with respect to said plane reference surface. Preferably, the second direction is perpendicular to the first direction. Preferably, the first lowered contact surface is a plane surface.

According to a preferred embodiment, the first lowered contact surface is inclined, along a first direction, by a first angle included between 1.20° and 19°, preferably equal to 9.50°, with respect to the plane reference surface, while the same first lowered contact surface is not inclined, along a second direction, with respect to the plane reference surface (meaning that it is parallel to the plane reference surface). Still preferably, the second direction is perpendicular to the first direction and/or, preferably, the first lowered contact surface is a plane surface.

According to another preferred embodiment, the first lowered contact surface is not inclined, along a first direction, with respect to the plane reference surface (meaning that it is parallel to the plane reference surface), while the same first lowered contact surface is inclined, along a second direction, by a second angle included between 1.2° and 8°, preferably equal to 3.80°, with respect to the plane reference surface. Still preferably, the second direction is perpendicular to the first direction and/or preferably the first lowered contact surface is a plane surface.

In a preferred embodiment, the second lowered contact surface is inclined, along a first direction, included between 1.2° and 18°, preferably equal to 7.50°, with respect to said plane reference surface by a first angle.

According to a preferred embodiment of the invention, the second lowered contact surface is inclined, along a second direction, by a second angle included between 1.2° and 13°, preferably equal to 6.90°, with respect to said plane reference surface. Preferably, the second direction is perpendicular to the first direction.

Preferably, the second lowered contact surface is a plane surface.

According to a preferred embodiment, the second lowered contact surface is inclined, along a first direction, by a first angle included between 1.2° and 18°, preferably equal to 7.50°, with respect to the plane reference surface, while the same second lowered contact surface is not inclined, along a second direction, with respect to the plane reference surface (meaning that it is parallel to the plane reference surface). Still preferably, the second direction is perpendicular to the first direction and/or preferably the first lowered contact surface is a plane surface.

According to another preferred embodiment, the second lowered contact surface is not inclined, along a first direction, with respect to the plane reference surface (meaning that it is parallel to the plane reference surface), while the same second lowered contact surface is inclined, along a second direction, by a second angle included between 1.2° and 13°, preferably equal to 6.90°, with respect to the plane reference surface. Still preferably, the second direction is perpendicular to the first direction and/or preferably the first lowered contact surface is a plane surface.

In a preferred embodiment, the articulation means comprise means suited to allow the rotary coupling of the component with the successive component of the item, around a rotation axis.

According to a preferred embodiment of the invention, the articulation means comprise a pin aligned along the rotation axis.

The subject of the present invention includes also a jewellery and/or costume jewellery item such as, for example, a chain, a small chain, a necklace, a bracelet, an earring and similar items, wherein said item comprises at least one component for jewellery and/or costume jewellery items made as described above.

BRIEF DESCRIPTION OF THE DRAWINGS

Further advantages, objects and characteristics, as well as further embodiments of the present invention are defined in the claims and are illustrated below by means of the following description with reference to the attached drawings; in the drawings, corresponding or equivalent characteristics and/or component parts of the present invention are identified by the same reference numbers. In particular:

FIG. 15 shows an axonometric view of the elements of FIG. 14;

FIG. 18 shows an axonometric view of the elements of FIG. 17;

DETAILED DESCRIPTION OF PREFERRED EMBODIMENTS OF THE PRESENT INVENTION

Figure 1:
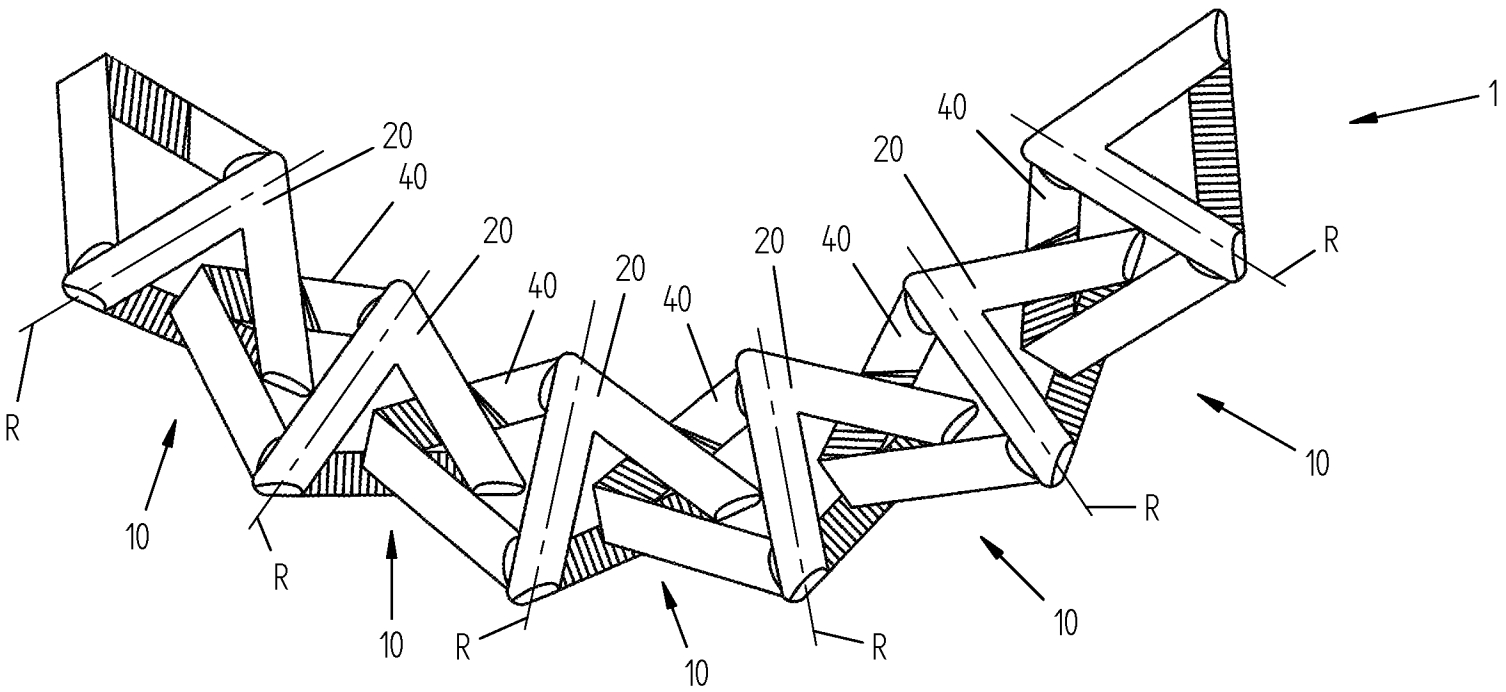
FIG. 1 shows a plan view of a jewellery and/or costume jewellery item in an operating position of use, comprising a plurality of components according to a first embodiment of the present invention.

Although the present invention is described below with reference to its embodiments illustrated in the drawings, the present invention is not limited to the embodiments described below and illustrated in the drawings. On the contrary, the embodiments described below and illustrated in the drawings clarify some aspects of the present invention, the scope of which is defined in the claims.

The present invention can be especially but not exclusively applied in the field of necklace manufacturing. For this reason, the present invention is described here below with special reference to its application to a necklace. However, it should be noted that the applications of the present invention are not limited to the case of necklaces; on the contrary, the present invention can also be advantageously applied in the production of components for jewellery and/or costume jewellery items such as, for example, chains, small chains, bracelets, earrings and similar items.

Figure 2A:
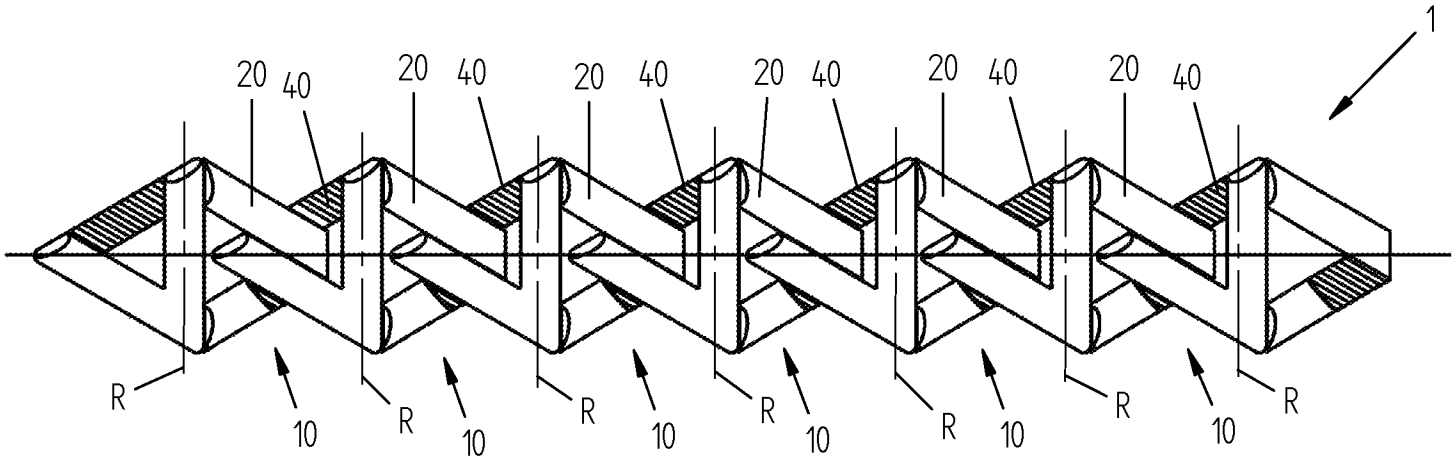
FIG. 2A shows the item of FIG. 1 in a different operating position.
Figure 2B:
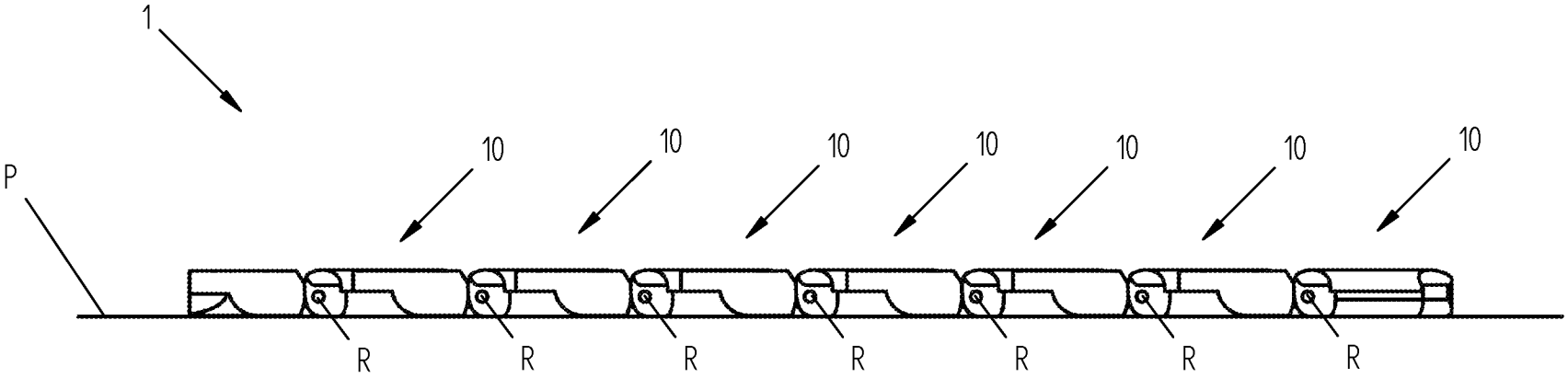
FIG. 2B shows a side view of the item of FIG. 2A resting on a reference plane.

FIGS. 1, 2A and 2B show a jewellery and/or costume jewellery item 1 according to the present invention, obtained by connecting together several components 10 according to the present invention, hereinafter also referred to as chain sections 10.

The jewellery and/or costume jewellery item 1 shown by way of example is constituted by a necklace and is preferably obtained by preparing a suitable number of components 10, or chain sections 10, which depends on the overall length to be achieved, and connecting them to one another in succession, as is better described below. In the figures, the necklace 1 is shown partially, that is, without the fastening system suited to join its ends (known per se and not forming part of the subject of the present invention).

FIG. 1 shows the necklace 1 in its actual operating position of use when worn on the neck, while FIG. 2 shows the necklace in a different, flat operating position.

It should be noted that the jewellery and/or costume jewellery item 1 shown in FIG. 2 and indicated as the necklace 1 in a different, flat operating position may preferably constitute even a bracelet (obviously considering a convenient length for use as a bracelet).

A first embodiment of the component 10 according to the present invention is described below with reference to Figures from 3 to 12; in the figures, similar or equivalent characteristics and/or component parts are identified by the same reference numbers.

The component 10 according to the present invention comprises a first element 20 and a second element 40 connected together in such a way as to form a chain section 10.

Figure 3:
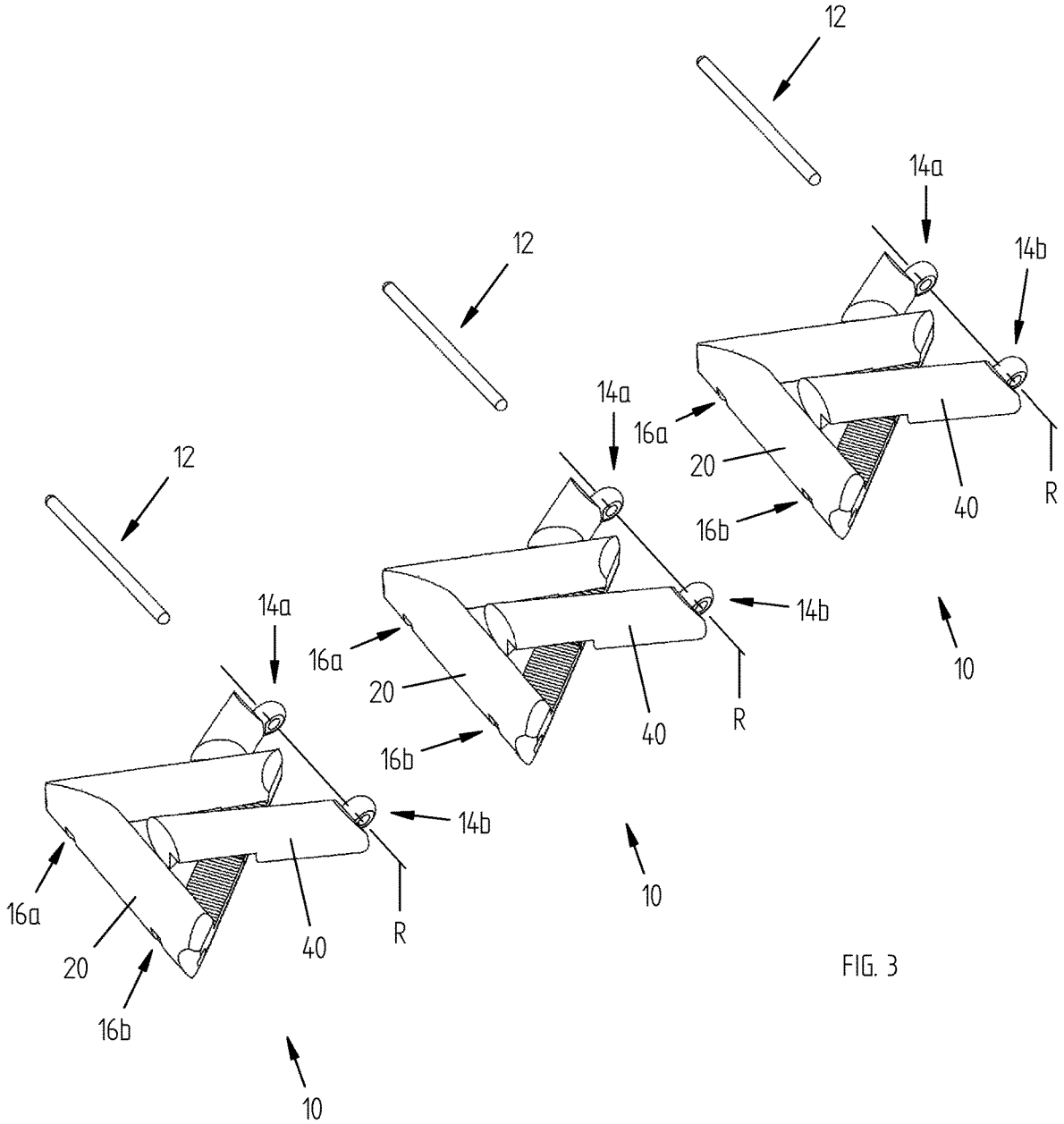
FIG. 3 shows a plurality of components according to the invention in a possible mutual position for their assembly and the creation of the item shown in FIG. 1.

As explained above, joining several chain sections 10 to one another and in succession it is possible to obtain the desired necklace 1. FIG. 3 shows, by way of example, three chain sections 10 prepared to be connected to obtain the necklace 1.

According to a first aspect of the present invention, each chain section 10 comprises articulation means 12 for coupling a chain section 10 with a successive chain section 10. Preferably, said articulation means 12 allow the rotary coupling of a chain section 10 with the successive chain section 10 around a rotation axis R for making the necklace 1 (or bracelet).

According to the preferred embodiments illustrated in the figures, said articulation means comprise a pin 12 arranged aligned along said rotation axis R. In variant embodiments, however, said articulation means can be made in a different way, equivalent to the use of an element like an articulation pin as illustrated and described in greater detail here below in this description. For example, the articulation means may comprise one or more elements projecting from the first element and/or from the second element and suited to cooperate with respective seats created in the second element and/or the first element in such a way as to allow said rotary coupling around the rotation axis R to be carried out. The projecting elements can be preferably provided with protruding rotation elements made in a single piece with the projecting elements and suited to be inserted in corresponding rotation recesses created in said seats. The use of a rotation pin as a separate piece with respect to the two elements of the component can thus be advantageously avoided.

When the necklace 1 is worn, the articulation means 12 allow it to adapt to and advantageously lie around the user's neck, following the varying curves of the body, or more advantageously around the wrist in the case of a bracelet.

Figure 4A:
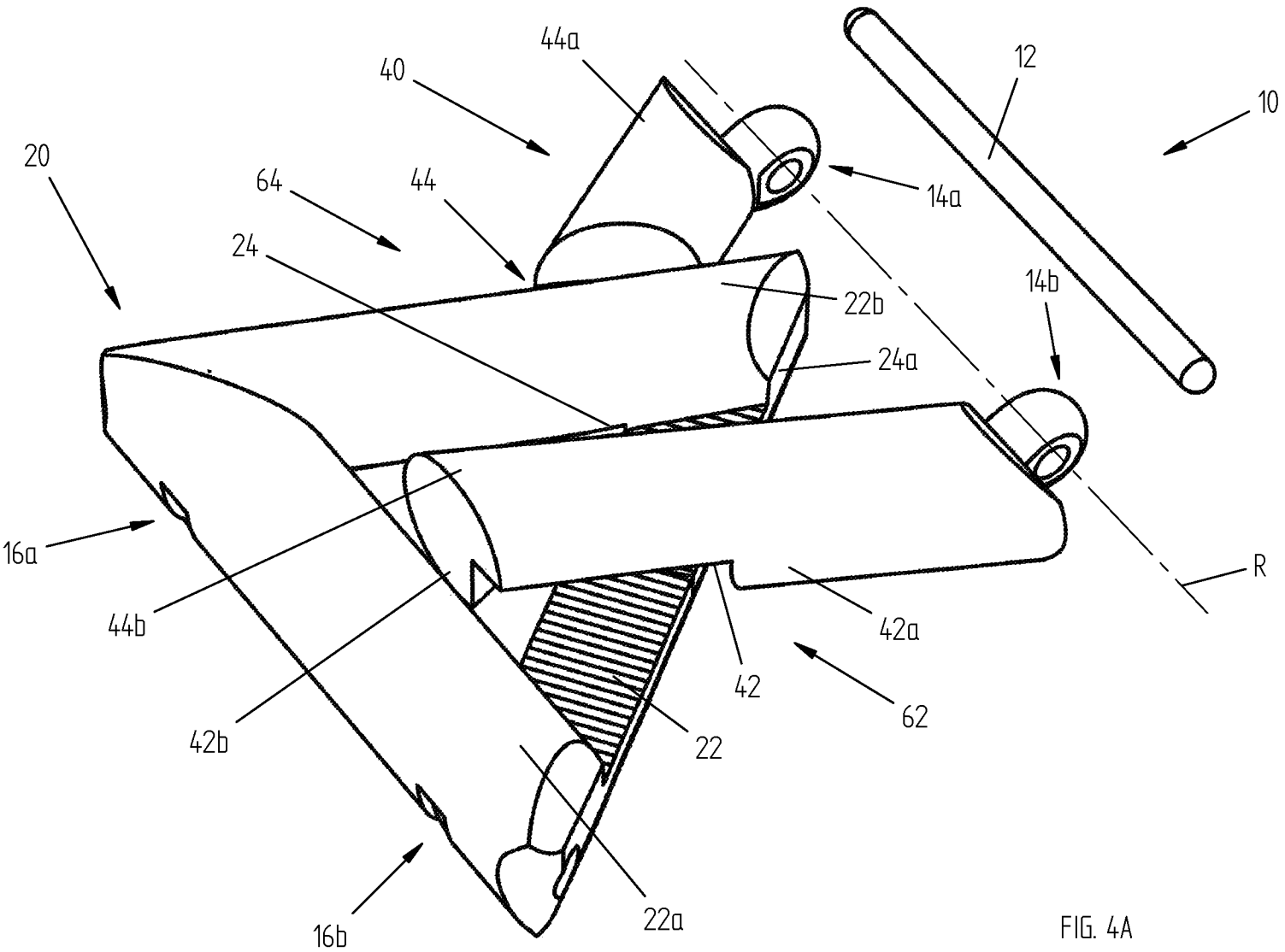
FIG. 4A shows an enlarged detail of FIG. 3.

According to another aspect of the present invention, the first element 20 and the second element 40 can be coupled at the level of two contact areas 62, 64, as illustrated in FIG. 4A.

At the level of the first contact area 62, preferably, the first element 20 comprises a first contact surface 22 which is lowered with respect to the adjacent surfaces 22*a*, 22*b* and suited to receive a second surface 42 of the second element 40. In said embodiment, also the second surface 42 of the second element 40 is lowered with respect to the adjacent surfaces 42*a*, 42*b*.

Figure 4B:
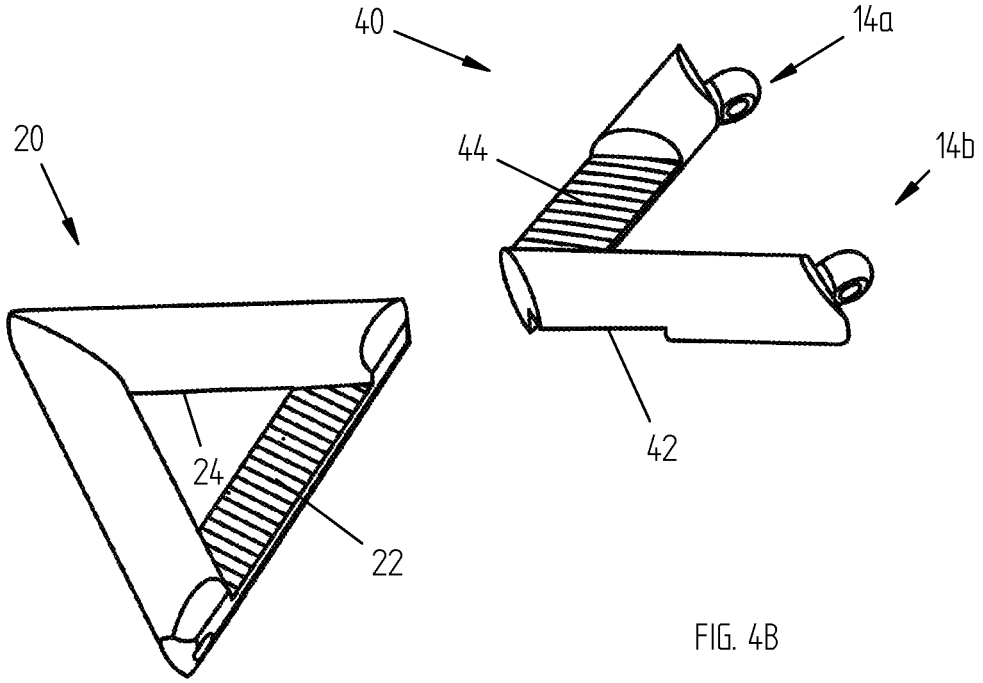
FIG. 4B shows an exploded view of FIG. 4A.
Figure 9A:
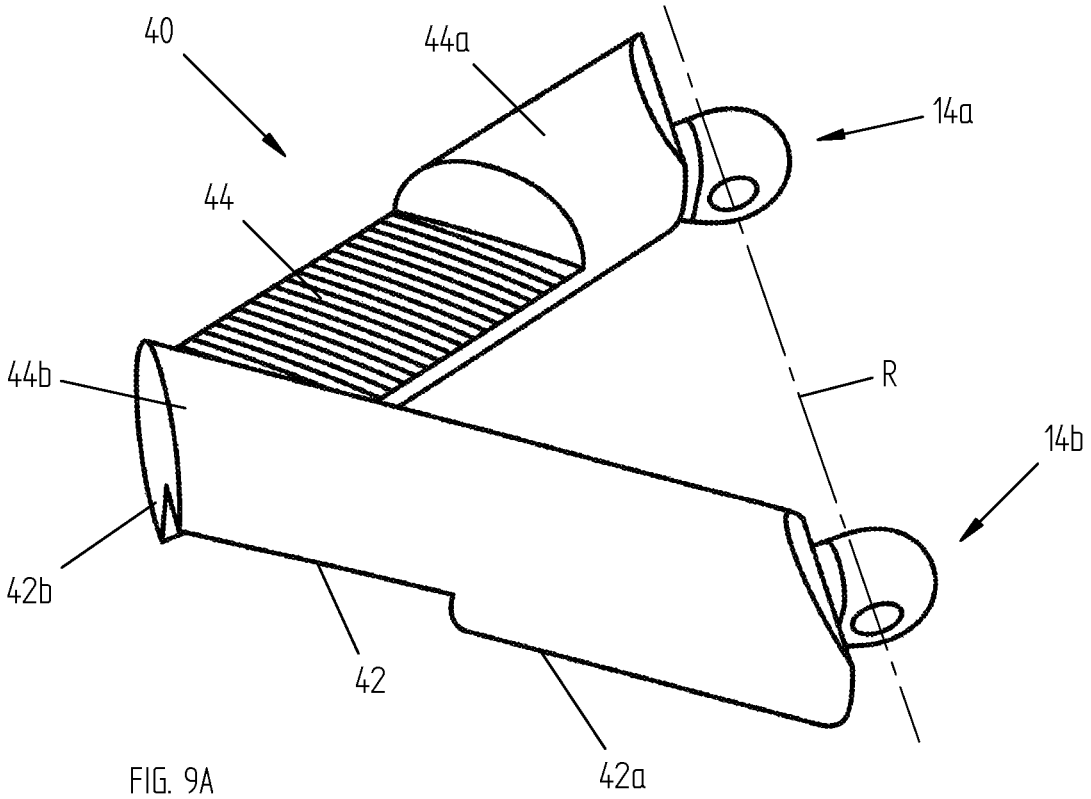
FIG. 9A shows an enlarged detail of FIG. 4B.
Figure 9B:
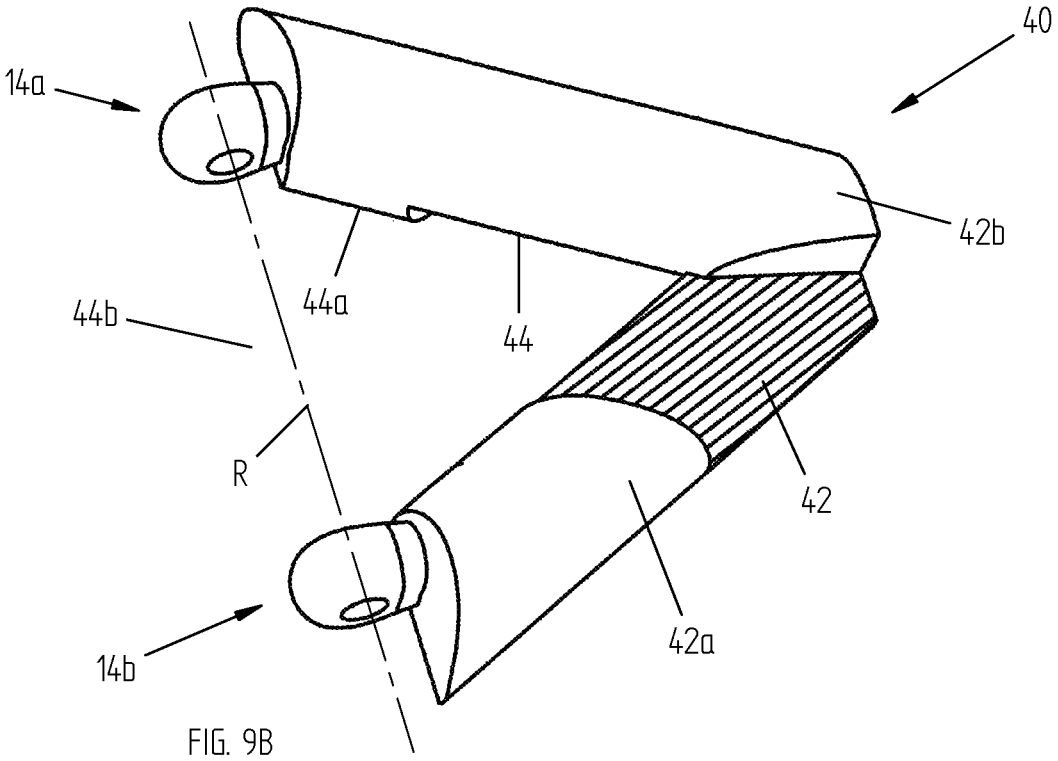
FIG. 9B shows the detail of FIG. 9A according to another point of view.

Analogously, at the level of the second contact area 64, preferably, the first element 20 comprises a first contact surface 24 lowered with respect to the adjacent surfaces 24*a*, 24*b* and suited to receive a second surface 44 of the second element 40, which is better visible in FIGS. 4B and 9A. In this embodiment, even the second surface 44 of the second element 40 is lowered with respect to the adjacent surfaces 44*a*, 44*b*.

Advantageously, the presence of said lowered areas 22, 42, 24, 44 at the level of the two contact areas 62, 64 of the two elements 20, 40 allows the two elements 20, 40 to be both arranged substantially parallel to a reference/supporting plane P once they have been connected to each other, as shown for example in FIG. 2B. In other words, when connected to each other the two elements 20, 40 assume the same orientation, with their respective longitudinal planes parallel to each other or coinciding with each other. This makes it possible to overcome the drawback of the known systems, in which the adjacent links of the necklace (or bracelet) tend to be oriented with their respective longitudinal planes of symmetry arranged on different planes and forming an angle, usually of approximately 90 degrees.

The expression "same orientation" of the two elements 20, 40 refers to the orientation of two respective planes defined for the first element 20 and the second element 40, wherein the plane of the first element 20 substantially corresponds to the plane passing through the points where the first element 20 rests on a plane reference surface P when the first element 20 has not yet been assembled with the second element 40, and wherein the plane of the second element 40 substantially corresponds to the plane passing through the points where the second element 40 rests on a plane reference surface P when the second element 40 has not yet been assembled with the first element 20.

The present solution thus makes it possible to obtain a better final aesthetic appearance compared to the systems of known type.

According to another aspect of the present invention, the first element 20 is preferably defined by a closed annular element. In the first embodiment illustrated herein, the closed annular shape preferably defines the shape of a triangle.

Figure 13:
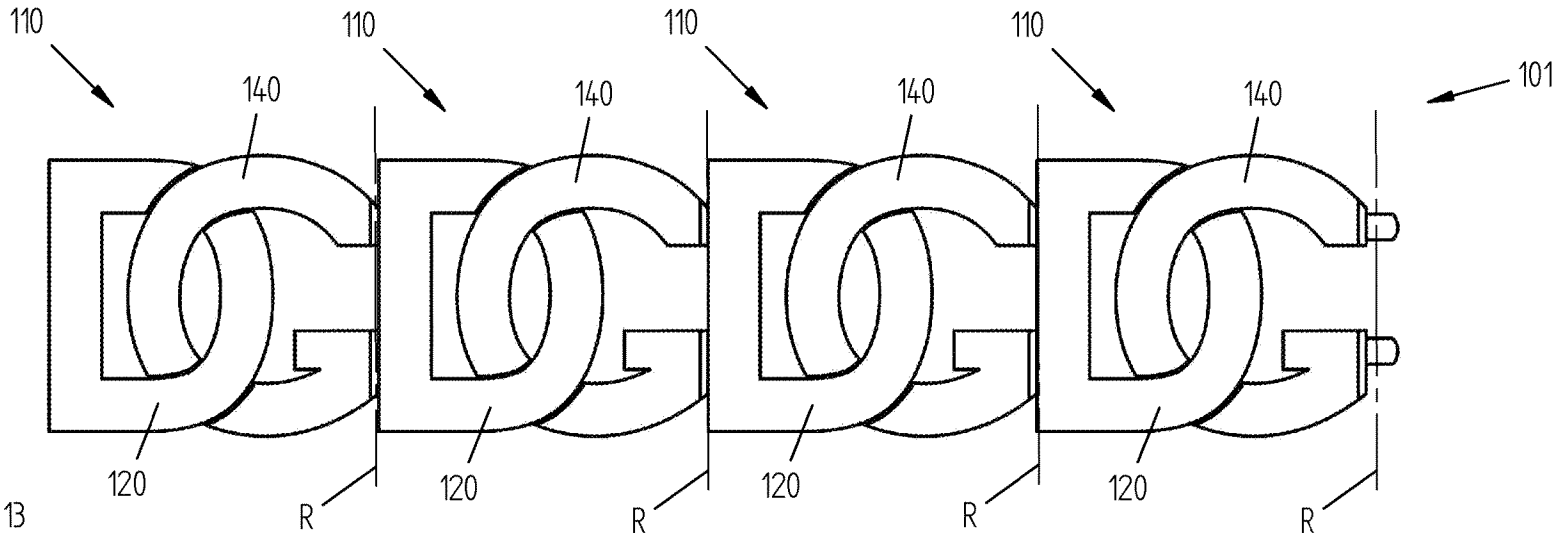
FIG. 13 shows a first variant embodiment of FIG. 1.

In variant embodiments, however, said shape can be any desired shape, preferably for the purpose of obtaining a different and desired aesthetic appearance, as illustrated for example with reference to the variant embodiment shown in FIGS. 13 and 15, in which the closed annular element has the shape of the letter D.

Figure 16:
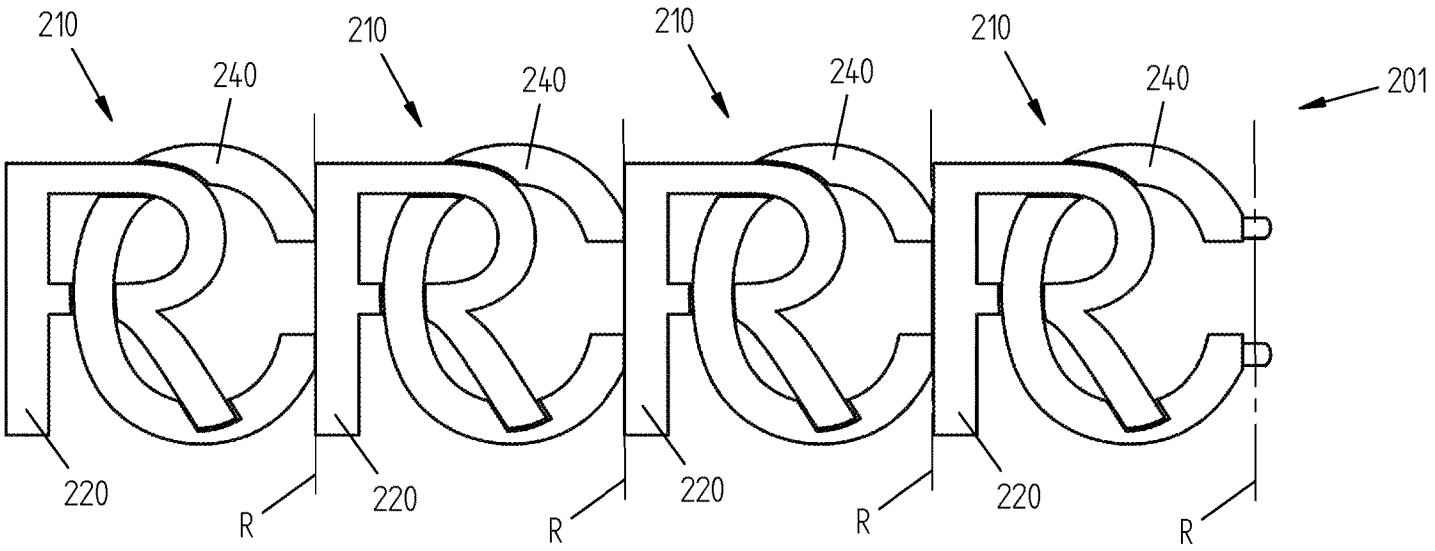
FIG. 16 shows a second variant embodiment of FIG. 1.

In addition to the above, in further variant embodiments the first element may preferably have only one section of the closed annular type, as illustrated for example with reference to the variant embodiment shown in FIGS. 16 and 18, in which the first element is constituted by the letter R and only its upper part is actually a closed annular section.

Figure 4C:
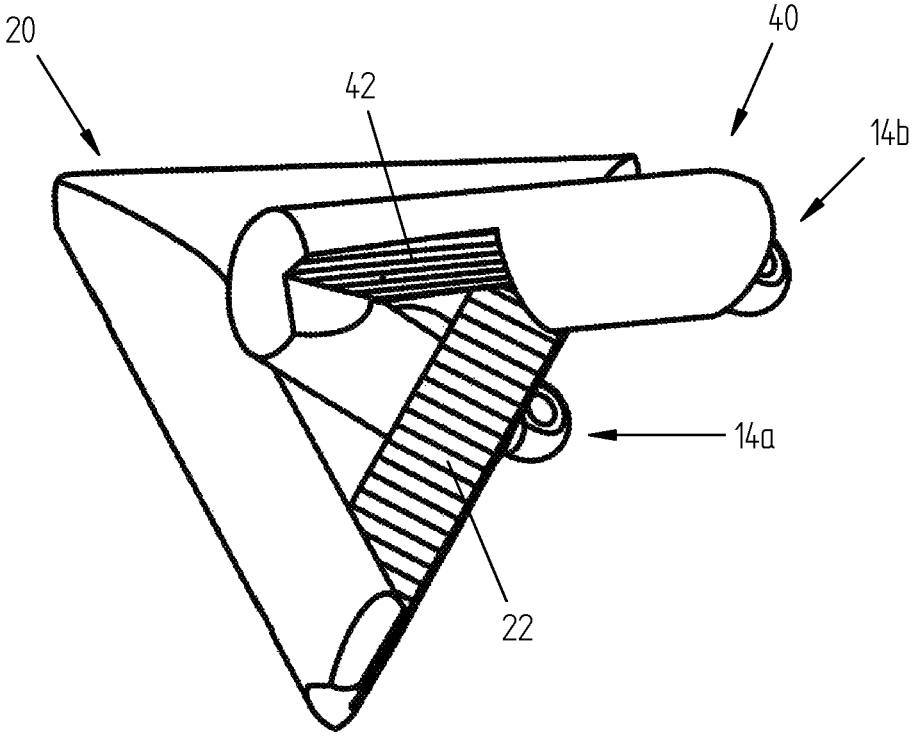
FIG. 4C shows the elements of FIG. 4B in a step in which they are assembled together.

According to a further aspect of the present invention, the second element 40 is defined by an open element with free ends and is suited to be inserted in the closed annular section of the first element 20, as illustrated in FIG. 4C which shows a first step of the assembly of the two elements 20, 40 intended to obtain the component 10. In the first embodiment illustrated herein, preferably, the open element defines the shape of a V.

In variant embodiments, however, the desired shape can be any open shape, preferably for the purpose of obtaining a different and desired aesthetic appearance, as illustrated for example with reference to the variant embodiments shown in FIG. 13 or 16, in which the second element has a shape that respectively defines the letter G and the letter C.

The open shape of the second element 40 allows the latter to be assembled with the first element 20, in particular through its insertion in the closed annular section of the first element 20, as shown, in fact, in FIG. 4B.

Clearly, the presence of a closed annular section in the first element 20 makes it possible to prevent the second element 40 from coming off once it has been inserted therein. It is also evident that the second element 40 can be prevented from coming off the first element 20 also using a not necessarily closed shape, that is, possibly provided with an opening whose size is such that in any case the second element 40 cannot come off.

Once the second element 40 has been inserted in the first element 20, the elements themselves can be mutually rotated and be advantageously arranged with the same orientation, as explained above.

Once the second element 40 has been assembled with the first element 20, it is possible to make the necklace 1 by joining several components 10 in succession by means of the articulation pins 12.

Figure 5A:
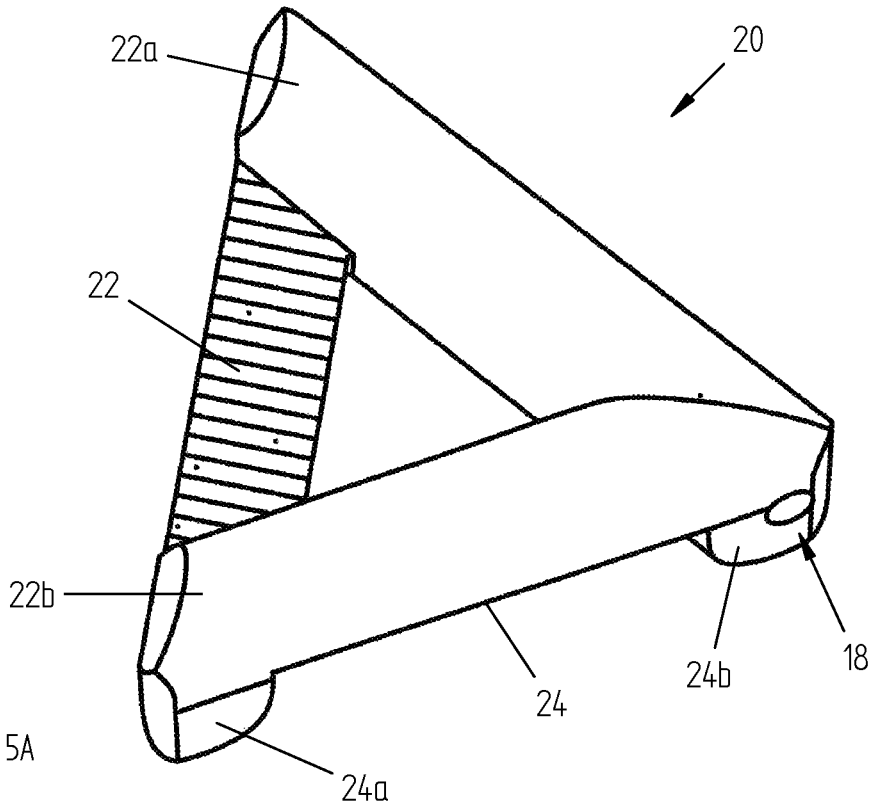
FIG. 5A shows an enlarged detail of FIG. 4B.
Figure 5B:
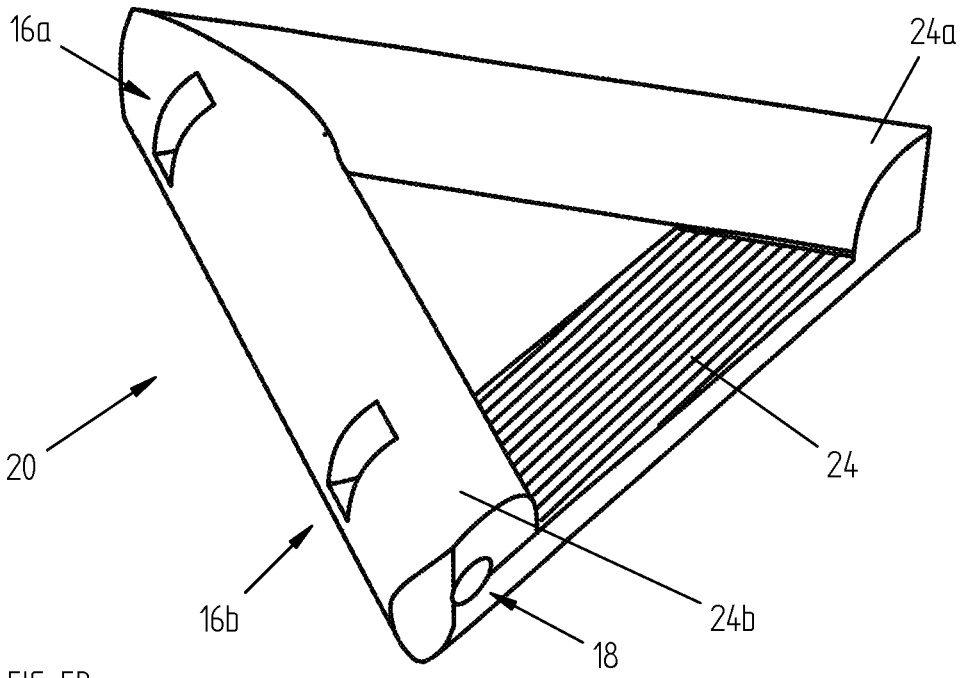
FIG. 5B shows the detail of FIG. 5A according to another point of view.

The connection of the components 10 by means of the articulation pins 12 is preferably obtained through two seats 16*a*, 16*b* created in the first element 20, better visible in FIG. 5B, suited to receive respective eyelets 14*a*, 14*b* projecting from the second element 40. The eyelets 14*a*, 14*b* are preferably created at the free ends of the second element 40.

The eyelets 14*a*, 14*b* of a first component 10 are inserted in the seats 16*a*, 16*b* created in the successive component 10. The articulation pin 12 is thus inserted in an opening/through hole 18 of the first element 20 involving the two seats 16*a*, 16*b*, better visible in FIG. 5B. The articulation pin 12 is inserted in the through hole 18 so as to intersect the two eyelets 14*a*, 14*b* and revolvingly constrains the two adjacent components 10.

The through hole 18 is preferably made in the first element 20, more preferably in the side of the first element 20 provided with the two seats 16*a*, 16*b*. Advantageously, once it has been inserted in the through hole 18, the articulation pin 12 is completely concealed, which is consequently advantageous from an aesthetic point of view.

According to a further aspect, the areas 22, 42, 24, 44 which are lowered at the level of the two contact areas 62, 64 are preferably shaped in such a way as to allow a mutual movement, or degree of freedom, between the two elements 20, 40 of the component 10, allowing for the curvature necessary for the necklace to be worn on the user's neck.

Said curvature is shown in FIG. 1, in which it is possible to observe how the two elements 20, 40 inside each component 10 are slightly rotated with respect to each other, contrary, for example, to what is shown in FIG. 2A, in which the necklace 1 is shown in the flat position, when not worn, or considering that in the case of a bracelet said curvature is actually not needed.

According to another advantageous aspect of the present invention, to make the necklace 1 easier to wear, the lowered areas 22, 42, 24, 44 have convenient inclinations, as described below.

In a preferred embodiment, the lowered areas 22, 42, 24, 44 are preferably constituted by plane surfaces.

More preferably, therefore, to make the necklace 1 easier to wear, said plane surfaces defining the lowered areas 22, 42, 24, 44 feature convenient inclinations. Figures from 6A to 8A show the preferred inclinations of the first lowered area 22 of the first element 20.

Figure 7A:
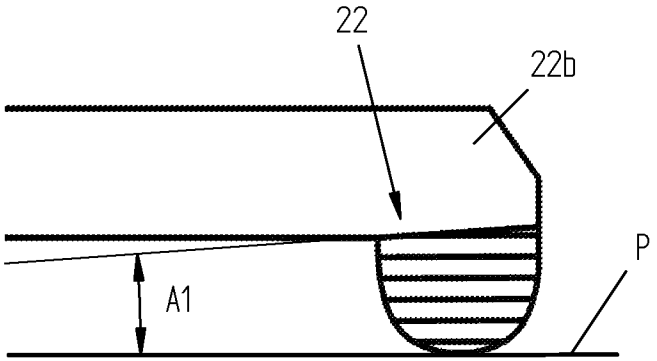
FIG. 7A shows the sectional view along section line VIIA°-VIIA° of FIG. 6A.

FIG. 7A shows a first inclination A1 of the first lowered area 22 along a first direction, or transverse direction, which with respect to the reference plane P is preferably equal to 9.50°. Said inclination is preferably included between 1.20° and 19°.

Figure 8A:
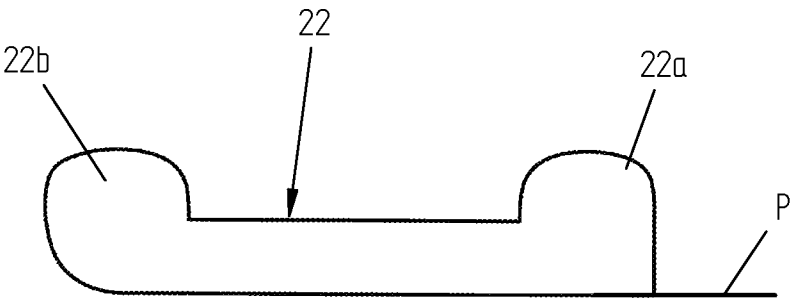
FIG. 8A shows the sectional view along section line VIIIA°-VIIIA° of FIG. 6A.
Figure 6A:
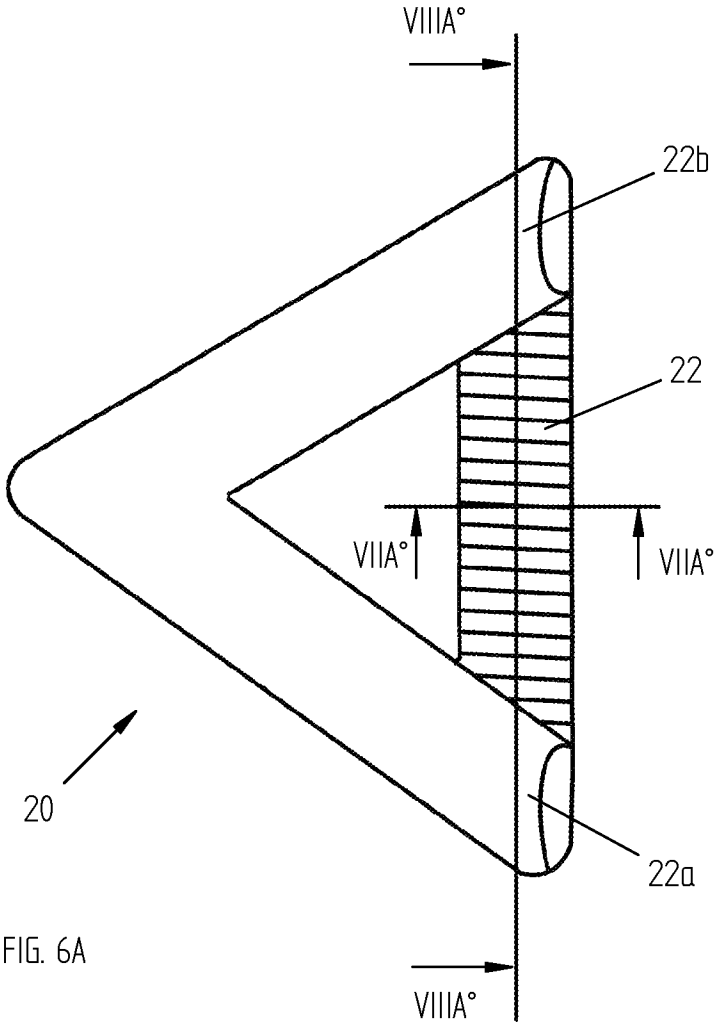
FIG. 6A shows a plan view of the element of FIG. 5A.

FIG. 8A shows the preferred development of the first lowered area 22 along a second direction, or longitudinal direction, which with respect to the reference plane P is parallel, meaning that preferably it is not inclined.

The longitudinal direction considered is substantially perpendicular to the transverse direction.

Figures from 6B to 8B show the preferred inclinations of the other first lowered area 24 of the first element 20.

Figure 7B:
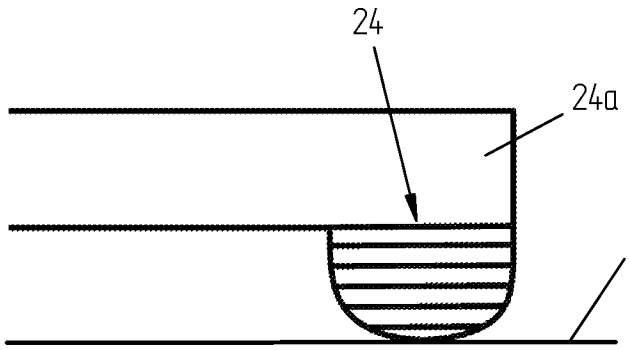
FIG. 7B shows the sectional view along section line VIIB°-VIIB° of FIG. 6B.

FIG. 7B shows the preferred development of the first lowered area 24 along a first direction, or transverse direction, which with respect to the reference plane P is parallel, meaning that preferably it is not inclined.

Figure 8B:
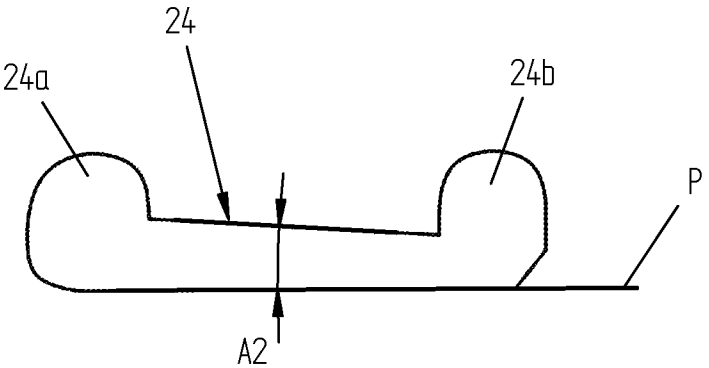
FIG. 8B shows the sectional view along section line VIIIB°-VIIIB° of FIG. 6B.
Figure 6B:
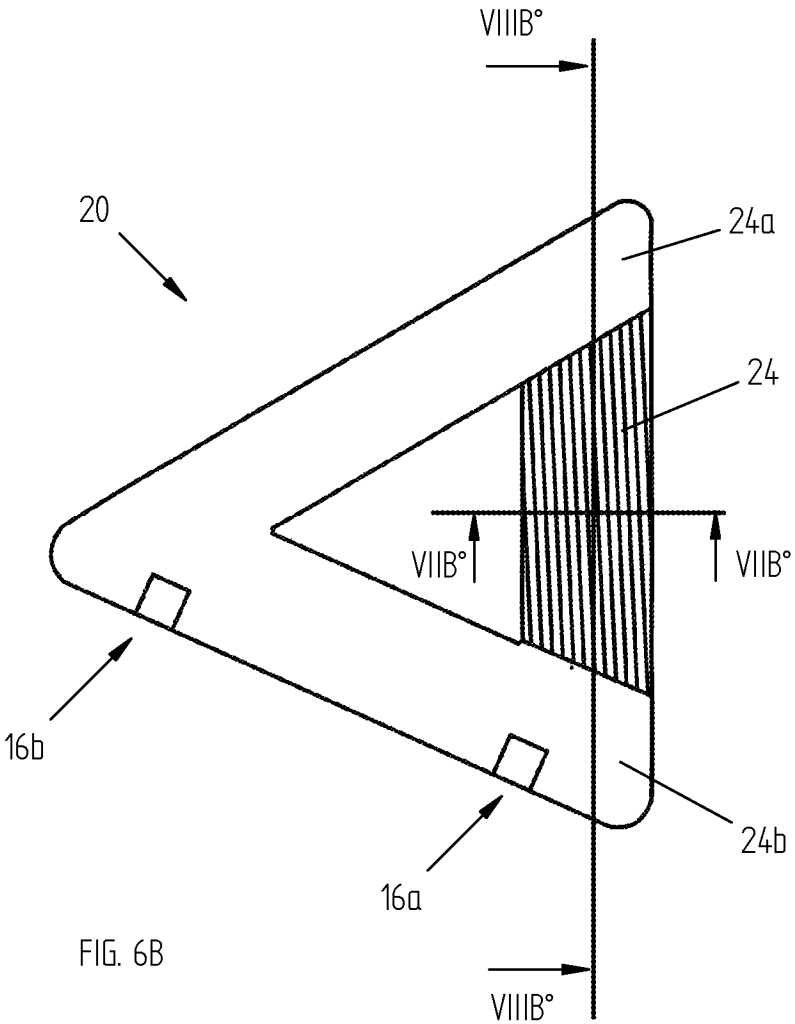
FIG. 6B shows a plan view of FIG. 5B.

FIG. 8B shows a second inclination A2 of the first lowered area 24 along a second direction, or longitudinal direction, which with respect to the reference plane P is preferably equal to 3.80°. Said inclination is preferably included between 1.20° and 8°.

Also in this case, the longitudinal direction considered is substantially perpendicular to the transverse direction.

Figures from 10A to 12A show the preferred inclinations of the second lowered area 44 of the second element 40.

Figure 11A:
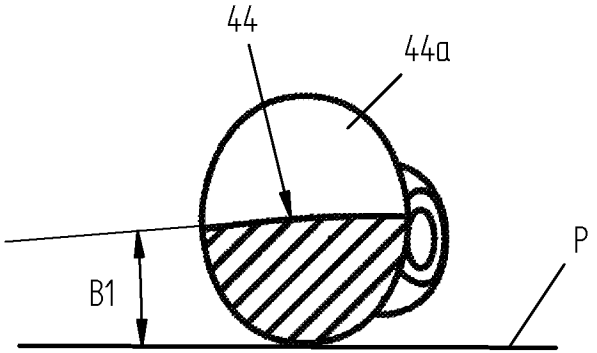
FIG. 11A shows the sectional view along section line XIA°-XIA° of FIG. 10A.

FIG. 11A shows a first inclination B1 of the second lowered area 44 along a first direction, or transverse direction, which with respect to the reference plane P is preferably equal to 7.50°. Said inclination is preferably included between 1.20° and 18°.

Figure 12A:
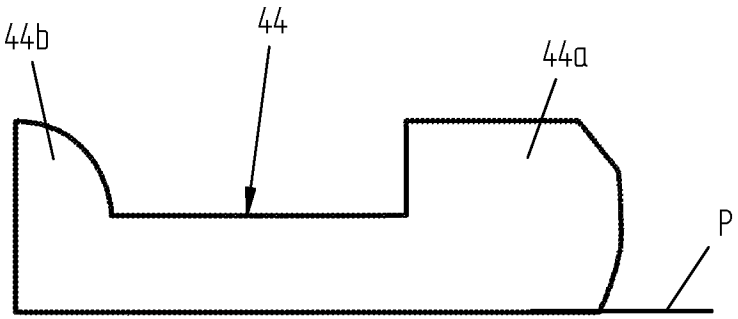
FIG. 12A shows the sectional view along section line XIIA°-XIIA° of FIG. 10A.
Figure 10A:
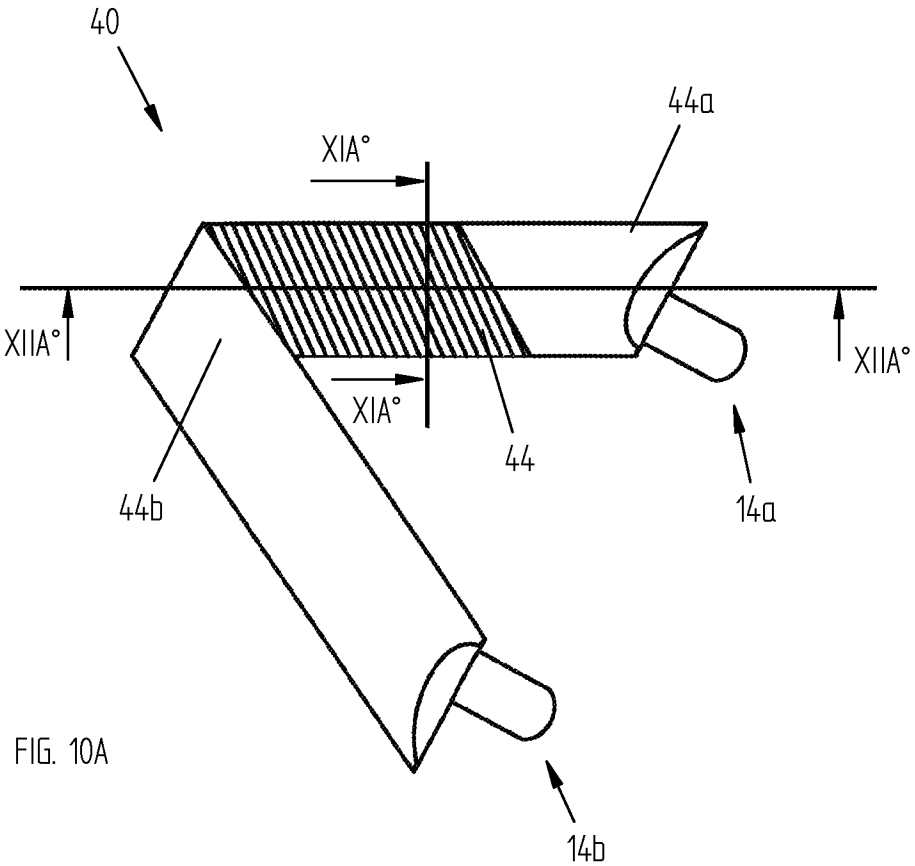
FIG. 10A shows a plan view of the element of FIG. 9A.

FIG. 12A shows the preferred development of the second lowered area 44 along a second direction, or longitudinal direction, which with respect to the reference plane P is parallel, meaning that preferably it is not inclined.

Also in this case, the longitudinal direction considered is substantially perpendicular to the transverse direction.

Figures from 10B to 12B show the preferred inclinations of the other second lowered area 42 of the second element 40.

Figure 11B:
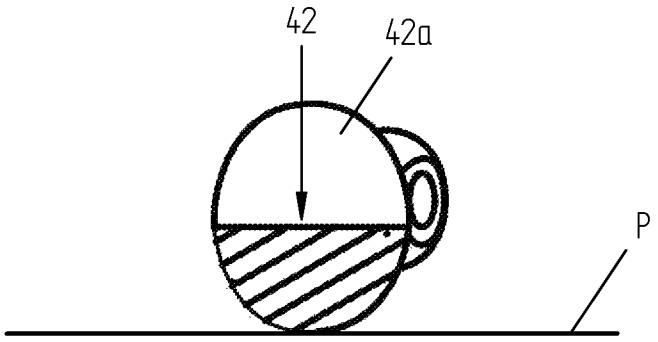
FIG. 11B shows the sectional view along section line XIB°-XIB° of FIG. 10B.

FIG. 11B shows the preferred development of the second lowered area 42 along a first direction, or transverse direction, which with respect to the reference plane P is parallel, meaning that preferably it is not inclined.

Figure 12B:
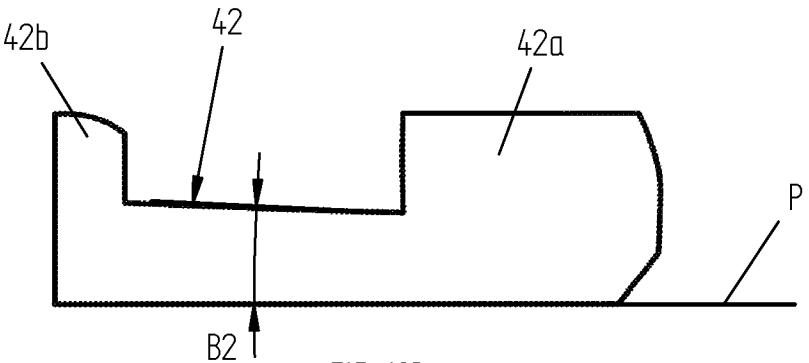
FIG. 12B shows the sectional view along section line XIIB°-XIIB° of FIG. 10B.
Figure 10B:
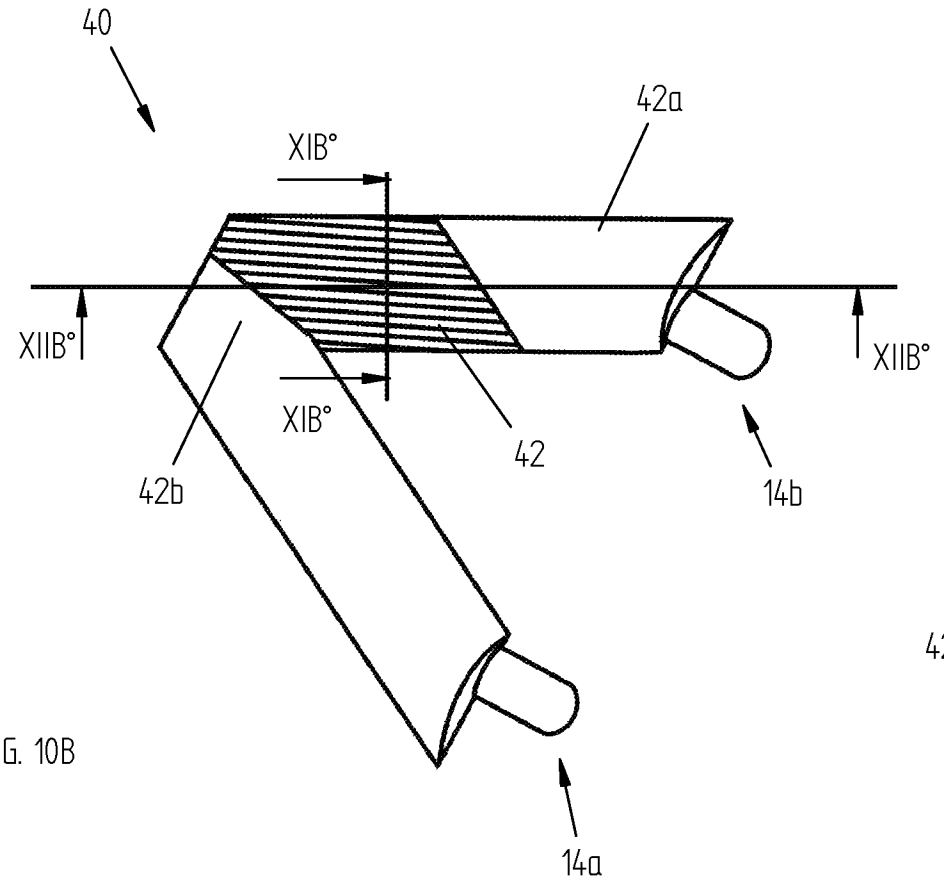
FIG. 10B shows a plan view of the element of FIG. 9B.

FIG. 12B shows a second inclination B2 of the second lowered area 42 along a second direction, or longitudinal direction, which with respect to the reference plane P is preferably equal to 6.90°. Said inclination is preferably included between 1.20° and 13°.

Also in this case, the longitudinal direction considered is substantially perpendicular to the transverse direction.

As already explained, the inclinations of the lowered surfaces make the item 1 easier to wear, preferably when the latter is constituted by a necklace 1.

In variant embodiments, however, said surfaces may not be inclined, for example when the item is constituted by a bracelet or an earring.

The description provided above shows that the component according to the present invention makes it possible to simplify and speed up the assembly operations of the item to be obtained, for example a chain, a necklace or a bracelet. Furthermore, using components or chain sections 10 whose elements have different shapes and sizes, it will also be possible to obtain items with different aesthetic characteristics; for this purpose, it will only be necessary to have components or chain sections according to the present invention provided, in fact, with elements in different shapes and/or sizes. The assembly operations can thus be carried out not only in the factory and therefore not only at the source, as is the case for the items known in the art, but directly in the point of sale, by the seller and according to the tastes and needs of the customer or buyer. Said operations, furthermore, are very simple and do not require the use of special equipment or tools.

Figures from 13 to 15 show an alternative solution for a jewellery and/or costume jewellery item 101 according to the present invention, obtained by connecting several components 110, or chain sections 110, to one another according to an alternative embodiment of the present invention.

Said embodiment differs from the embodiment previously described in that the first element 120 and the second element 140 of the chain section 110 have a different shape and in particular:

the first element 120 is in the shape of the letter D and the second element 140 is in the shape of the letter G.

Figure 14:
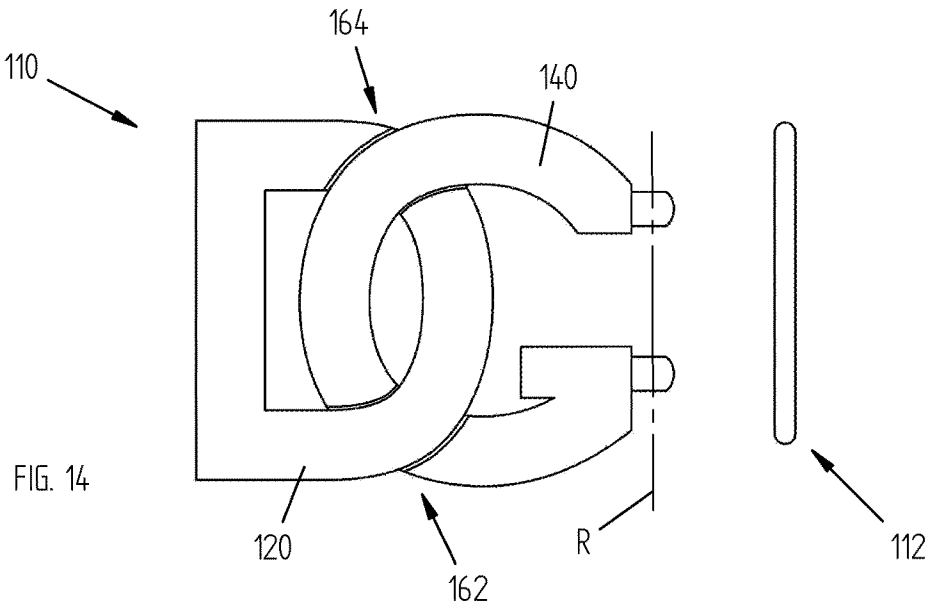
FIG. 14 shows a partially exploded enlarged detail of FIG. 13.

The chain section 110 comprises articulation means 112 for coupling a chain section 110 with a successive chain section 110 (FIG. 14). Preferably, as for the first embodiment, said articulation means 112 comprise a pin 112 arranged so that it is aligned along the rotation axis R.

The first element 120 and the second element 140 can be coupled at the level of two contact areas 162, 164 (indicated in FIG. 14).

At the level of the first contact area 162, preferably, the first element 120 comprises a first contact surface 122 which is lowered with respect to the adjacent surfaces (see FIG. 15) and suited to receive a second surface 142 of the second element 140. In said embodiment, even the second surface 142 of the second element 140 is lowered with respect to the adjacent surfaces.

Analogously, at the level of the second contact area 164, preferably, the first element 120 comprises a first contact surface 124 which is lowered with respect to the adjacent surfaces (see FIG. 15) and suited to receive a second surface 144 of the second element 140. In said embodiment, even the second surface 144 of the second element 140 is lowered with respect to the adjacent surfaces.

Said embodiment makes it possible to achieve the same advantages described above with reference to the first embodiment.

Figures from 16 to 18 show another alternative solution for a jewellery and/or costume jewellery item 201 according to the present invention, obtained by connecting several components 210, or chain sections 210, to one another according to another alternative embodiment of the present invention.

Said embodiment differs from the first embodiment previously described in that the first element 220 and the second element 240 of the chain section 210 have a different shape and in particular:

the first element 220 is in the shape of the letter R and the second element 240 is in the shape of the letter C.

Figure 17:
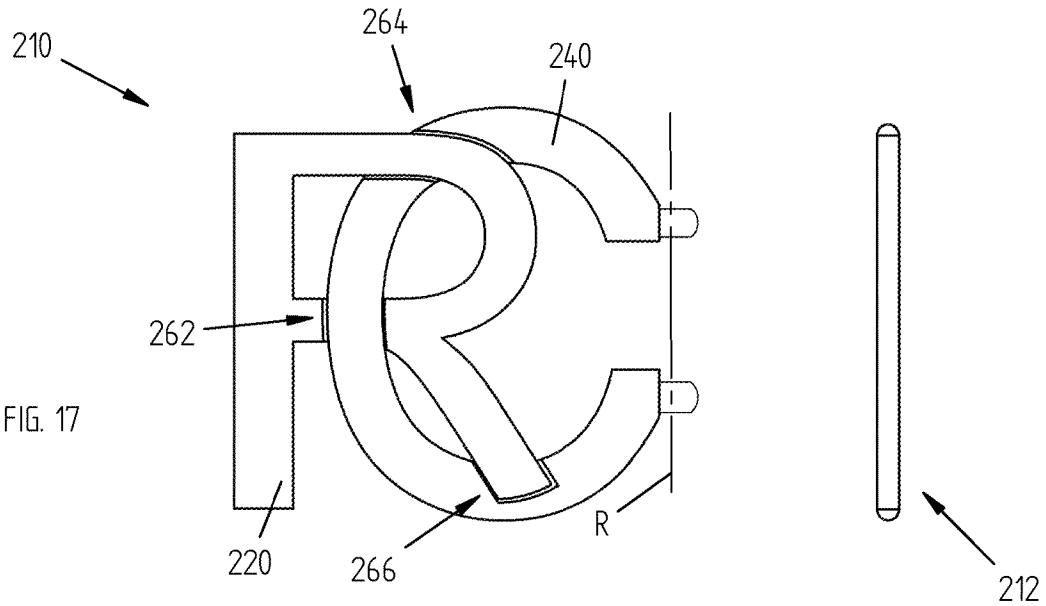
FIG. 17 shows a partially exploded enlarged detail of FIG. 16.

The chain section 210 comprises articulation means 212 for coupling a chain section 210 with a successive chain section 210 (FIG. 17). Preferably, as for the previous embodiments, said articulation means 212 comprise a pin 212 arranged so that it is aligned along the rotation axis R.

The first element 220 and the second element 240 can be coupled at the level of two contact areas 262, 264.

The two contact areas 262, 264 are preferably defined at the level of the closed annular section constituted by the upper part of the letter R and a section of the letter C.

At the level of the first contact area 262, preferably, the first element 220 comprises a first contact surface 222 which is lowered with respect to the adjacent surfaces and suited to receive a second surface 242 of the second element 240. In said embodiment, even the second surface 242 of the second element 240 is lowered with respect to the adjacent surfaces.

Analogously, at the level of the second contact area 264, preferably, the first element 220 comprises a first contact area 224 which is lowered with respect to the adjacent surfaces and suited to receive a second surface 244 of the second element 240. In said embodiment, even the second surface 244 of the second element 240 is lowered with respect to the adjacent surfaces.

Furthermore, preferably, the first element 220 and the second element 240 can be coupled even at the level of a third contact area 266.

At the level of the third contact area 266, preferably, the first element 220 comprises a first contact surface 226 which is lowered with respect to the adjacent surfaces and suited to receive a second surface 246 of the second element 240. In said embodiment, even the second surface 246 of the second element 240 is lowered with respect to the adjacent surfaces.

Said embodiment makes it possible to achieve the same advantages described above with reference to the first embodiment.

Figure 19:
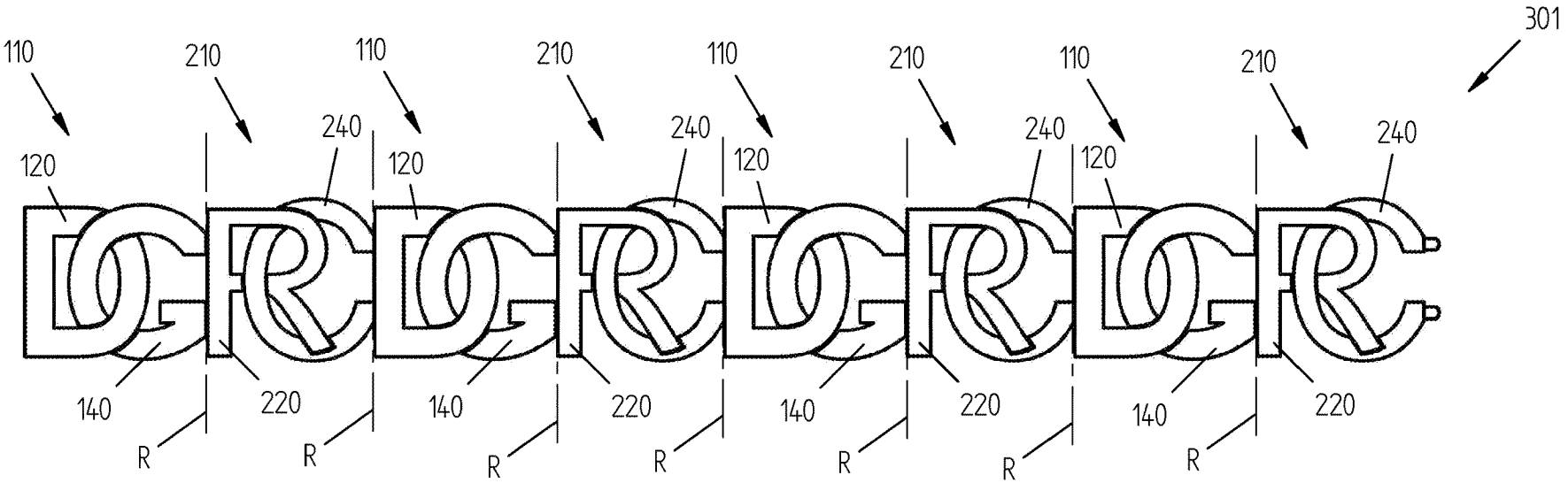
FIG. 19 shows a third variant embodiment of FIG. 1.

FIG. 19 shows a further alternative solution for a jewellery and/or costume jewellery item 301 according to the present invention, obtained by connecting several components 110, 210, or chain sections 110, 210 to one another according to another alternative embodiment of the present invention. In the figures, similar or equivalent characteristics and/or component parts are identified by the same reference numbers.

Said embodiment shows that the item 301 can be obtained by means of components 110, 210 constituted by elements (first elements 120, 220 and second elements 140, 240) in different shapes as desired.

The production of an item of this type is substantially and preferably possible thanks to the possibility to make the first element 120, 220 of each component 110, 210 with at least one closed annular section inside which the corresponding second element 140, 240 is inserted during the assembly step.

Finally, it should be noted that the lowered contact surfaces of the various alternative embodiments, illustrated and not illustrated, can feature or not inclinations as described above in order to make the item easier to wear, if necessary, preferably when the latter is constituted by a necklace.

It has thus been shown that the component according to the present invention allows the set objects to be achieved. In particular, the present invention makes it possible to overcome the problems that are typically found by jewellers during the design and production of jewellery items such as, for example, necklaces, chains, bracelets, earrings and similar items.

The present invention makes it possible to facilitate the operations required for the assembly of a chain section comprising at least two elements, wherein said assembly method makes it possible to avoid complex operations such as, for example, welding. The solution according to the present invention is also extremely versatile, as it makes it possible to assemble bracelets and/or chains in a simple and immediate manner while at the same time guaranteeing also an improved aesthetic appearance and better wearability compared to the solutions of the known type.

While the present invention has been described with reference to the specific embodiments shown in the figures, it should be noted that the present invention is not limited to the specific embodiments represented and described herein; on the contrary, further variants of the embodiments described herein fall within the scope of the present invention, which is defined in the claims.

The invention claimed is:

1. A component for making jewelry chains, including necklaces, bracelets, or earrings, the component comprising:

a first element;

a second element connected to the first element to form a chain section;

wherein the first element and the second element have different geometries from each other and are configured to be coupled together at first and second contact areas;

wherein in at least one of the first and second contact areas of the first element comprises a first contact surface which is lowered with respect to a plurality of adjacent surfaces, wherein the first lowered contact surface is configured to receive a second contact surface of the second element, and wherein the component comprises an articulation means for coupling the component with another component wherein the first element comprises at least one closed annular section on which the first and second contact areas are defined and the second element is an open element with free ends, configured for insertion in a closed annular section of a first element of said another component.

2. The component of claim 1, wherein the second contact surface of the second element comprises a contact surface which is lowered with respect to the plurality of adjacent surfaces.

3. The component of claim 1, wherein in both of first and second contact areas the first element comprises first contact surfaces which are lowered with respect to the adjacent surfaces and configured to receive second contact surfaces of the second element.

4. The component of claim 3, wherein the second contact surfaces of the second element comprise contact surfaces which are lowered with respect to the adjacent surfaces.

5. The component of claim 1, wherein the first element and the second element are connected to each other and configured to be oriented in substantially the same direction with respect to a plane reference surface.

6. The component of claim 1, wherein the first lowered contact surface is inclined along a first direction with respect to the plane reference surface by a first angle included between 1.20° and 19°.

7. The component of claim 6, wherein the first lowered contact surface is inclined along a second direction with respect to the plane reference surface by a second angle included between 1.2° and 8°.

8. The component of claim 6, wherein the first lowered contact surface is a plane surface.

9. The component of claim 1, wherein the second lowered contact surface is inclined along a first direction with respect to the plane reference surface by a first angle included between 1.2° and 18°.

10. The component of claim 9, wherein the second lowered contact surface is inclined along a second direction with respect to the plane reference surface by a second angle included between 1.2° and 13°.

11. The component of claim 9, wherein the second lowered contact surface is a plane surface.

12. The component of claim 1, wherein the articulation means comprises means configured to allow the rotary coupling around a rotation axis of the component with a successive component.

13. The apparatus of claim 12, wherein the articulation means comprise a pin aligned along the rotation axis.

14. A method for forming a chain from a component comprising a first element and a second element, the method comprising:

coupling the first element and the second element, wherein the first element and second element have different geometries from each other and are configured to be coupled together at first and second contact areas;

wherein the component comprises an articulation means for coupling the component with another component and wherein the first element comprises at least one closed annular section on which the first and second contact areas are defined, and the second element is an open element with free ends, for insertion in a closed annular section of a first element of said another component;

wherein in at least one of the first and second contact areas of the first element comprises a first contact surface which is lowered with respect to a plurality of adjacent surfaces wherein the first lowered contact surface is configured to receive a second contact surface of the second element; and coupling a plurality of components together by way of the articulation means.

15. The method of claim 14, wherein the second contact surface of the second element comprises a contact surface which is lowered with respect to the plurality of adjacent surfaces.

16. The method of claim 14, wherein in both of first and second contact areas the first element comprises first contact surfaces which are lowered with respect to the adjacent surfaces and configured to receive second contact surfaces of the second element.

17. The method of claim 14, wherein the second contact surfaces of the second element comprise contact surfaces which are lowered with respect to the adjacent surfaces.

18. The method of claim 14, wherein the first element and the second element are connected to each other and configured to be oriented in substantially the same direction with respect to a plane reference surface.

19. The method of claim 14, wherein the first lowered contact surface is inclined along a first direction with respect to the plane reference surface by a first angle included between 1.20° and 19°.

20. The method of claim 14, wherein the articulation means comprises a pin along a rotation axis of the component with a successive component.

* * * * *